US005297498A

United States Patent [19]

Donner

[11] Patent Number: 5,297,498

[45] Date of Patent: Mar. 29, 1994

[54] DEVICE FOR CONNECTING CONTAINERS

[75] Inventor: Julius Donner, Barschlüte, Fed. Rep. of Germany

[73] Assignee: Conver-OSR Ozeanservice-Reparatur Ingenieurtechnik GmbH, Bremen, Fed. Rep. of Germany

[21] Appl. No.: 761,419

[22] Filed: Sep. 17, 1991

[30] Foreign Application Priority Data

Sep. 25, 1990 [DE] Fed. Rep. of Germany ..... 4030337

[51] Int. Cl.[5] ..... B60P 7/13

[52] U.S. Cl. ..... 114/75; 410/78

[58] Field of Search ..... 114/364, 343, 72, 75, 114/266, 267; 410/70, 68, 76, 52, 89, 63, 135, 77-84; 24/287

[56] References Cited

U.S. PATENT DOCUMENTS

| | | | |
|---|---|---|---|
| 2,411,900 | 12/1946 | Seward . | |
| 2,972,175 | 2/1961 | Abulins . | |
| 3,718,218 | 2/1973 | Shields | 214/10.5 R |
| 3,722,714 | 3/1973 | Morris et al. | 214/10.5 R |
| 3,734,442 | 5/1973 | Lunde | 248/361 |
| 3,894,493 | 7/1975 | Strecker | 105/366 |
| 4,212,251 | 7/1980 | DiMartino | 24/73 |
| 4,277,212 | 7/1981 | Rosaia | 410/78 |
| 4,294,185 | 10/1981 | Nordstrom et al. | 114/75 |
| 4,564,984 | 1/1986 | Takaguchi | 24/287 |
| 4,626,155 | 12/1986 | Hlinsky et al. | 410/82 |
| 4,768,905 | 9/1988 | Reynard | 410/78 |
| 4,782,561 | 11/1988 | Hayama | 24/287 |

FOREIGN PATENT DOCUMENTS

| | | | |
|---|---|---|---|
| 0268415 | 11/1987 | European Pat. Off. | B65D 90/00 |
| 2153933 | 10/1971 | Fed. Rep. of Germany | B65D 21/02 |
| 7528229 | 9/1978 | Fed. Rep. of Germany | B65D 21/02 |
| 2902058 | 7/1979 | Fed. Rep. of Germany | B63B 25/24 |
| 3234613 | 4/1983 | Fed. Rep. of Germany | B63B 25/28 |
| 8311706.7 | 7/1983 | Fed. Rep. of Germany | B63D 25/22 |
| 3220743 | 8/1983 | Fed. Rep. of Germany | B63B 25/22 |
| 2734750 | 8/1985 | Fed. Rep. of Germany | B65D 21/02 |
| 3538892.7 | 5/1988 | Fed. Rep. of Germany | B63B 25/22 |
| 3642399 | 6/1988 | Fed. Rep. of Germany | B63B 25/22 |
| 3710419 | 10/1988 | Fed. Rep. of Germany | B63D 25/22 |
| 3809834.2 | 11/1988 | Fed. Rep. of Germany | B63B 25/22 |
| 8800132 | 9/1988 | Sweden | B65D 21/01 |
| 2056412 | 10/1979 | United Kingdom | B65D 21/02 |

OTHER PUBLICATIONS

European Search Report EP 91 11 4687, dated Dec. 12, 1991.

Dipl.-Ing. J. Gloystein and Prof. Dr.-Ing. E. Lehmann *Stauung von Containern im Laderaum von Massengutschiffen.*

Von Wolfram Blasius *Containertransporte mit dem Binnenschiff auf dem Rhein.*

*Steel Castings for Container Construction and Transportation* English Steel Casting Corporation, Ltd. 1971.

*Primary Examiner*—Edwin L. Swinehart

*Attorney, Agent, or Firm*—Cook, Egan, McFarron & Manzo, Ltd.

[57] ABSTRACT

A bridge fitting (10) for anchoring containers, stacked especially on ship's decks or hatches, is provided with two operatively connected connecting pieces (12, 13) which are arranged at a variable distance to one another and which determine the effective length of the bridge fitting (10). These connecting pieces (12, 13) engage container corner fittings (11) of two adjacent containers and the effective length of the bridge fitting (10) can be adjusted by a steplike shiftability und lockability of at least one of the two connecting pieces (12, 13).

12 Claims, 3 Drawing Sheets

DEVICE FOR CONNECTING CONTAINERS

BACKGROUND OF THE INVENTION

The invention relates to a device for connecting containers stacked on ships, especially on ship's decks, with two connecting pieces having hooking portions which are engagable to container corner fittings of adjacent containers, preferably of containers stacked side by side.

These type of devices are called bridge fittings in the art. They serve for anchoring the top layer of containers which are stacked for example on ship's decks or hatches. These devices each connect two adjacent containers in the horizontal direction. For this purpose, the device is provided with two hook-like or base-like hooking portions which engage the recesses of upper container corner fittings of two side by side containers. To bridge the space between two adjacent containers and to compensate for an inaccurate positioning of the containers relative to one another, the effective length of the device can be varied by changing the distance between the hooking portions or connecting pieces.

Known in the art is a device of this type in which the hooking portion of a first connecting piece is connected to an end of an adjusting portion in an articulated manner. One end of this adjusting portion passes through the second connecting piece. The part of the adjusting portion which is engaged to the second connecting piece is designed as a threaded rod, onto which the second connecting piece, provided with an appropriate nut, is screwed. By turning the nut on the adjusting portion of the first connecting piece, the distance between the hooking portions of the individual connecting pieces can be altered.

The above described known device has a relatively short service life. The thread which is locking the two connecting portions in a position with the required distance is easily damaged in practical operation by exterior impacts. Moreover, especially the thread corrodes very fast due to contact with salt water which can not be avoided on board a ship. To prevent this corrosion, the known device needs to be maintained and serviced regularly, which requires a high expenditure of labour, time and money. Furthermore, the adjustment of the distance between the hooking portions as required by the storage position of the containers is rather complicated as the nut has to be turned with an appropriate tool.

SUMMARY OF THE INVENTION

The invention is therefore based on the object to design a device of the type as described above in such a way that the distance between the hooking portions or connecting pieces can be easily adjusted as required by the respective position of the containers which are to be connected and that the device is also sturdy, durable and easy to handle.

To attain this object, the device according to the invention is characterized in that one of the connecting pieces is mounted on the other connecting piece in a step-like shiftable and lockable manner. As a result, the distance between the hooking portions can be easily adjusted in steps by shifting the connecting pieces of the device as taught by the invention relative to one another according to the catch and lock principle. As a result, the device according to the invention has a durable structure and it is unsusceptible to external impacts and easy to maintain. The absence of a thread, which in contrast is provided in prior art devices, prevents the danger of corrosion, especially caused by sea water. As a result, the device according to the invention has a substantially longer service life than ordinary devices of this type.

Moreover, the device according to the invention is easy to handle, particularly because the device, according to an essential feature of the invention, is only composed of two connecting pieces which are shiftably arranged on one another and which can be locked to one another accurately in a required position. No additional tools such as spanners are needed. Moreover, no special care has to be taken in sliding one connecting piece on the other, as the sensitive threads employed by prior art devices of this kind are not required in the device according to the invention.

According to a further proposal of the invention, the connecting pieces are provided with closely spaced catch steps, which ensures that the two connecting pieces can be connected to one another without any play. Consequently, the device can be accurately adapted to the given distances between adjacent containers or container corner fittings.

The catch steps are preferably designed as projections and depressions and the depressions are especially designed as wave-like annular grooves which are particularly resistant to external impacts. Alternately, continuous grooves having a trapezoidal or saw-tooth cross-section could also be used.

According to a further proposal of the invention, one of the two connecting pieces, namely a second connecting piece, is shiftably arranged on the first connecting piece. By rotating one connecting piece, a connection between the two connecting pieces can be established or released. In locked position, the catch steps of the first connecting piece engage corresponding counter catch steps of the second connecting piece, According to the invention, the catch steps and counter catch steps are designed such that in the shiftable position, the projections can be moved past one another, and they engage one another by a rotation of one of the two connecting pieces to a locked position.

In the most straightforward solution, the hooking portions of each connecting piece are designed approximately hook-like. For this purpose, they are provided with appropriate retaining lugs which engage the respective container corner fitting and can be locked therein.

In a preferred development of the apparatus according to the invention, the hooking portions are designed such that after they have been inserted into the respective container corner fittings, they are held therein almost rigidly, especially untiltably. As a result, the hooking portions do not apply any bending moment on the elongate adjusting portion of the first connecting piece. Consequently, the adjusting portion is only under a tensile load and can have accordingly small dimensions. The resulting lower weight is an important factor, especially regarding the handling of the device according to the invention.

Further subclaims disclose developments of the apparatus as taught by the invention.

BRIEF DESCRIPTION OF THE DRAWINGS

Two preferred embodiments will be explained below in detail with reference to the drawings, in which.

DETAILED DESCRIPTION OF THE PREFERRED EMBODIMENTS

Figure 1:
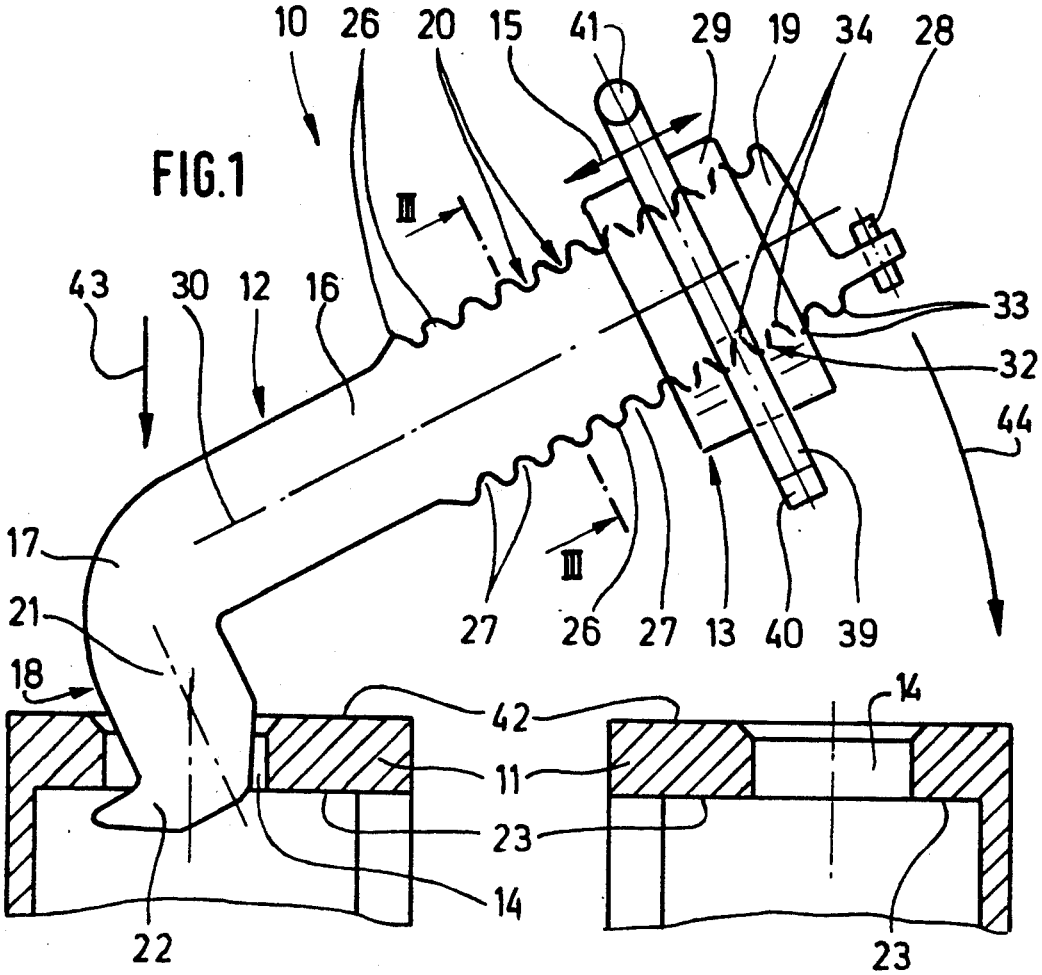
FIG. 1 is a side view of a first embodiment of the device designed as a bridge fitting, with a partly sectional view of container corner fittings, during the process of insertion.

The devices illustrated in the drawings are bridge fittings 10 for anchoring preferably the top layer of containers (not shown) stacked on a ship's deck or on hatches. The bridge fittings 10 provide a transversely and horizontally directed connection between two adjacent containers by bridging the container corner fittings 11 of the adjacent containers.

The bridge fitting 10 according to FIGS. 1 to 5 is provided with two connecting pieces 12, 13 which are in operative connection and which are arranged at a variable distance to one another and determine the effective length of the bridge fitting 10. Each of the two connecting pieces 12, 13 enters a recess 14 of the respective container corner fitting 11 of two adjacent containers (not shown). The second connecting piece 13 can be shifted backwards and forwards in the directions indicated by double arrow 15 on the first connecting piece 12 of the bridge fitting and can be locked accurately in a required position. The effective length of the bridge fitting 10 is determined by a steplike shiftability and lockability of the second connecting piece 13 on the first connecting piece 12.

The first connecting piece 12 has an elongated adjusting portion 16. A hooking portion 18 is integrally formed on one end 17 of the adjusting portion 16. In the region of an end 19 of the adjusting portion 16 which is directed away from the hooking portion 18, there are arranged a plurality of closely spaced catch steps 20 which hold the second connecting piece 13 in a shiftable and lockable manner. The hooking portion 18 has a hook-like shape and is provided with a leg 21 which is extending aproximately vertically relative to the adjusting portion 16. A retaining lug 22 is arranged on the end of this leg 21 and extends approximately parallel to the adjusting portion 16 and is directed away from the end 19 of the adjusting portion 16. The retaining lug 22 contacts the underside 23 of the container corner fitting 11 in the region of the soffit of the associated recess 14, especially when a load is exerted on the whole bridge fitting 10. The hooking portion 18, including its leg 21 and the retaining lug 22, is introduced into the associated recess 14 of the container corner fitting 11 by means of an appropriate rotation of the adjusting portion 16. The introduction or hooking movement is preferably conducted in the direction of the smaller dimension of the recess 14 which has an elongated oval shape.

Figure 3:
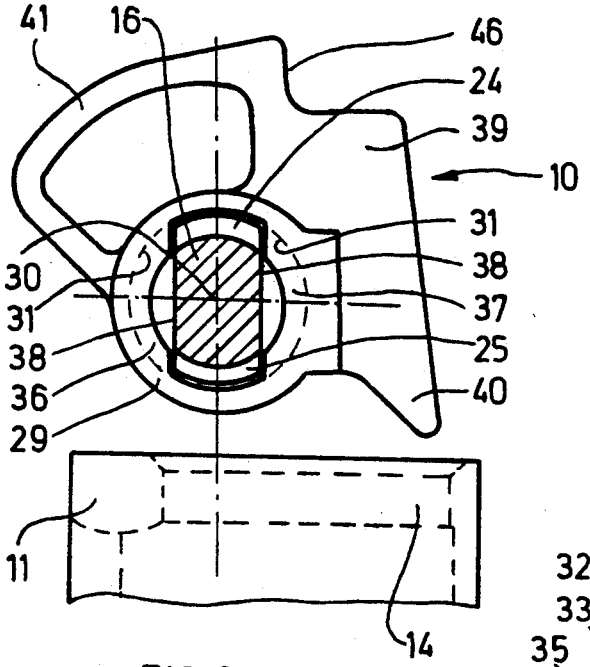
FIG. 3 is a cross-section of the bridge fitting in the shifting position taken along the line III—III of FIG. 1.
Figure 4:
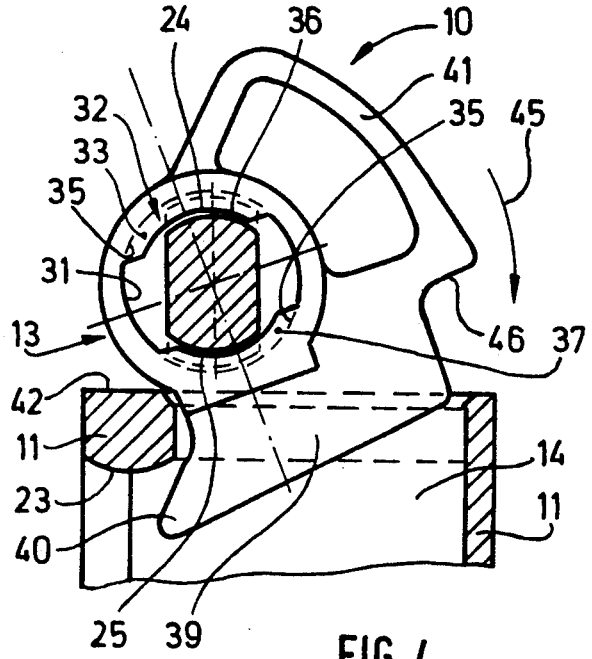
FIG. 4 is a further cross-section in analogy to FIG. 3, showing the device in a locking position.
Figure 5:
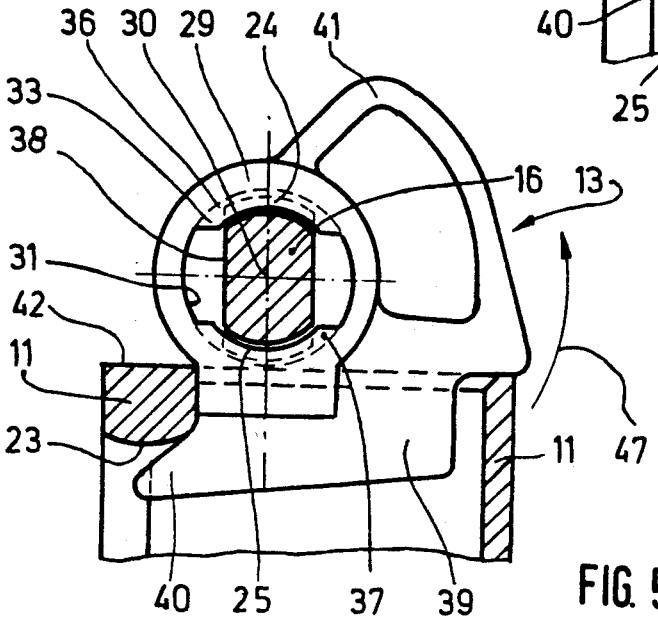
FIG. 5 is a cross-section of the bridge fitting in a final locked position, taken along the line V—V of FIG. 2.

The end 19 of the adjusting portion 16 which is provided with the catch steps 20 is designed approximately like a flatbar (see particularly FIGS. 3 to 5). The catch steps 20 are arranged on two opposite sides, especially on the top side 24 and the bottom side 25 of the connecting piece 16 and are thus assigned to curved portions between two opposite flat sides 48 on the cylindrical adjusting portion 16. The catch steps 20 on the end 19 of the adjusting portion 16 are formed on opposite sides 24, 25 by means of alternating projections 26 and depressions 27. The projections 26 and depressions 27 located along the curved portions of the top side 24 and the bottom side 25 of the flatbar-like end 19 of the adjusting portion 16 are in this case designed as wavelike annular grooves, Furthermore, the end 19 of the adjusting portion 16 is provided with a pin 28 which acts as a holding means and prevent the second connecting piece 13 from sliding off the end 19 of the adjusting portion 16 and thus getting lost.

Figure 2:
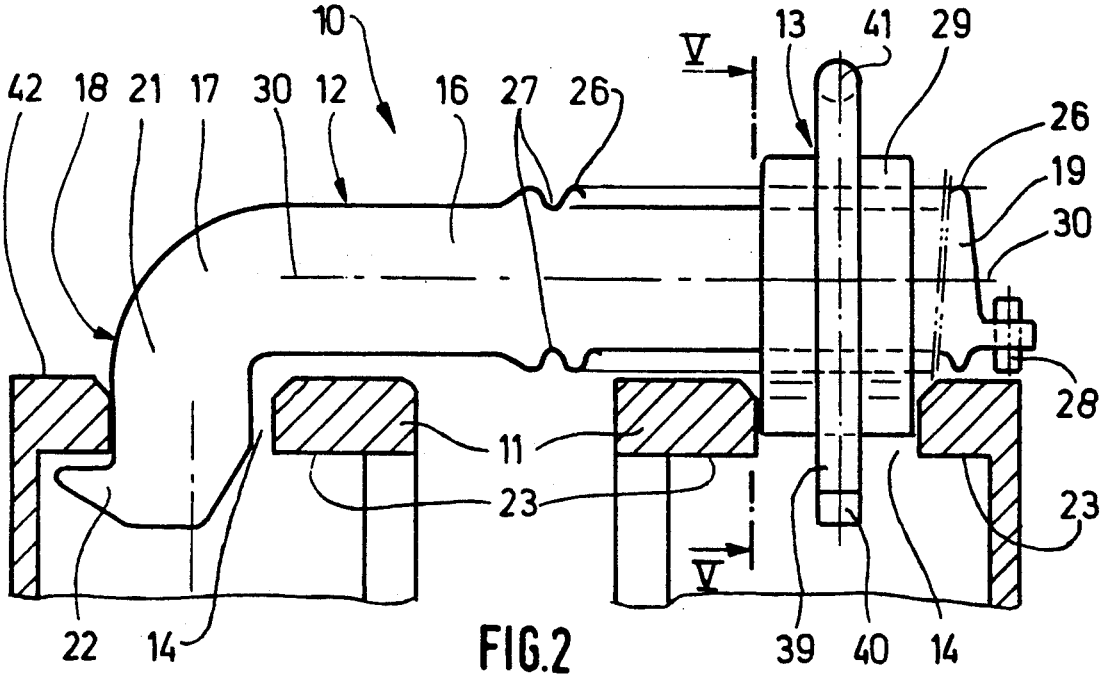
FIG. 2 shows a view of the bridge fitting according to FIG. 1 in locked position.

The second connecting piece 13 comprises an anchoring sleeve 29 which surrounds the end 19 of the adjusting portion 16 in the axial direction (see particularly FIGS. 1 and 2). The anchoring sleeve 29 of the second connecting piece 13 is designed such that the second connecting piece 13 can be shifted on the adjusting portion 16 provided with catch steps 20 and at the same time can be engaged to or disengaged from the adjusting portion 16 by means of a rotation about the longitudinal axis 30 of the adjusting portion 16. As illustrated in FIGS. 3 to 5, the inner periphery 31 of the anchoring sleeve 29 is provided with at least one, and in the present case three, counter catch steps 32. The counter catch steps 32 can be positively connected with the correspondingly designed catch steps 20 of the adjusting portion 16 by means of a rotation of the second connecting piece 13 about the longitudinal axis 30 of the adjusting portion 16.

The counter catch steps 32 on the inner periphery 31 of the anchoring sleeve 29 have the same form and shape as the catch steps 20 of the connecting piece 16 and are also spaced at the same distance to one another. In this regard, the counter catch steps 32 are also formed by annular grooves having a wave-like design with alternating projections 33 and depressions 34. But the projections 33 and depressions 34 are only provided along a partial inner periphery 35, especially on oppositely situated sides 36, 37 which essentially correspond to the flat sides 38 located between the top side 24 and the bottom side 25 of the flatbar-like adjuting portion 16. The oppositely situated projections 33 and 26 of the second connecting piece 13 and the end 19 of the adjusting portion 16, respectively, can thus be moved past one another in the shiftable position, as illustrated in FIG. 3. In the partial or in the final locking position, however, these projections 33 and 26 engage the oppositely situated depressions 27 and 34 in the region of the end 19 of the adjusting portion 16 of the first connecting piece 12, as illustrated in FIGS. 4 and 5. This engagement is established by rotating the second connecting piece 13 about the longitudinal axis 30 of the adjusting portion 16.

Furthermore, the second connecting piece 13 is provided with a hooking portion 39 with a retaining lug 40 integrally formed thereto. This retaining lug 40 contacts the underside 23 of the container corner fitting 11 in the region of the soffit of the associated recess 14. The anchoring base 39, with the retaining lug 40, engages the associated recess 14 by means of a rotation of the second connecting piece 13, together with its anchoring sleeve 29, about the longitudinal axis 30 of the adjusting portion 16. The hooking portion 39, together with the retaining lug 40, is inserted particularly in the direction of the greater dimension of the recess 14, which has an elongated oval shape, just like the recess into which the hooking portion 18 of the bridge fitting 10 is inserted, together with the retaining lug 22. Only the direction of insertion of the hooking portions 18 with retaining lug 22 and of hooking portion 39 with retaining lug 40 is different.

Additionally, the second connecting piece 13 is provided with a handle 41 or an actuating level of a similar type, which is arranged, especially for a better leverage, approximately diametrically relative to the retaining lug 40 formed on the hooking portion 39. As a result of the design of the bridge fitting 10 as taught by the invention, the adjusting portion 16, to which tensile and compressive loads can be exerted, is located only a small distance above the top side 42 of the two associated container corner fittings 11 and extends about parallel thereto, when, on the one hand, the hooking portion 18 and, on the other hand, the second connecting piece 13 are in an anchoring position. Thus, any bending moments caused by the transfer of forces and mainly affecting the adjusting portion 16, can be kept relatively small.

To fit the bridge fitting 10, it is firstly moved to an inclined position as illustrated in FIG. 1. At the same time, the hook-shaped hooking portion 18 with the formed retaining nose 22 is inserted into the associated recess 14 of the container corner fitting 11 of the one container, especially in the direction of the smaller dimension of the elongated oval recess 14, as indicated by arrow 43. By rotating the adjusting portion 16 about its end 17, as indicated by arrow 44, the retaining lug 22 contacts the underside 23 of the container corner fitting 11 in the region of the soffit of the recess 14. In the process of this rotation, the second connecting piece 13 is at the same time shifted in the axial direction on the adjusting portion 16 of the first connecting piece 12 as indicated by double arrow 15, in such a way that the second connecting piece 13 can partially engage the recess 14 with its anchoring sleeve 29 which corresponds in width approximately to the smaller dimension of the recess 14. Because of the special design of the catch steps 20 and counter catch steps 32, however, this axial transverse displacement of the second connecting piece 13 on the first connecting piece 12 can only be conducted in the shifting position as illustrated in FIG. 3. After the effective length of the bridge fitting 10 has been adjusted in this way, the second connecting piece 13 is positively engaged to the adjusting portion 16 via the interlocking catch steps 20 and counter catch steps 32 by a rotation of the second connecting piece 13 about the longitudinal axis 30 of the adjusting portion 16 as indicated by arrow 45 in FIG. 4. In the process of this rotation, the retaining lug 40 of the hooking portion 39 at the same time hooks under the underside 23 of the container corner fitting 11 and contacts same at the end of the rotating movement of the second connecting piece 13 in the region of the soffit of the recess 14, as illustrated in FIG. 5. A holding stop 46 is provided in the region where the hooking portion 39 merges into the handle 41, in order to, on the one hand, indicate the end of the rotating movement as indicated by arrow 45 when the device is fitted and, on the other hand, to support the second connecting piece 13 at a further place on the container corner fitting 11. At the end of the rotating movement of the second connecting piece 13 as illustrated in FIG. 5, this holding stop 46 is resting on the top side 42 of the container corner fitting 11, which completes the fitting of the bridge fitting 10 as taught by the invention.

To remove the bridge fitting 10, the second connecting piece 13 is first rotated back into the initial position as illustrated in FIG. 3 about the longitudinal axis 30 of the adjusting portion 16 of the first connecting piece 12 as indicated by arrow 47 in FIG. 5. This is followed by all movements described in connection with the fitting of the bridge fitting, but in reverse order.

Figure 6:
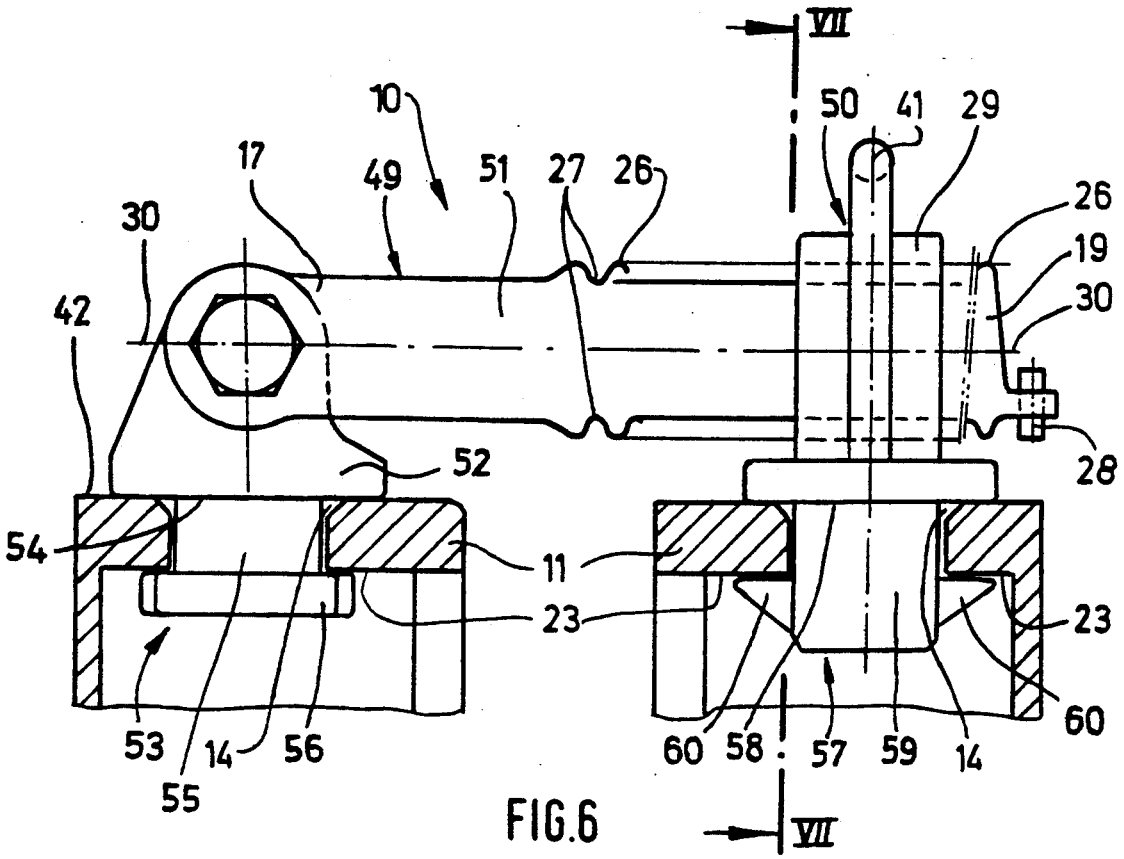
FIG. 6 shows a view in analogy to FIG. 2 of a second embodiment of a bridge fitting.
Figure 7:
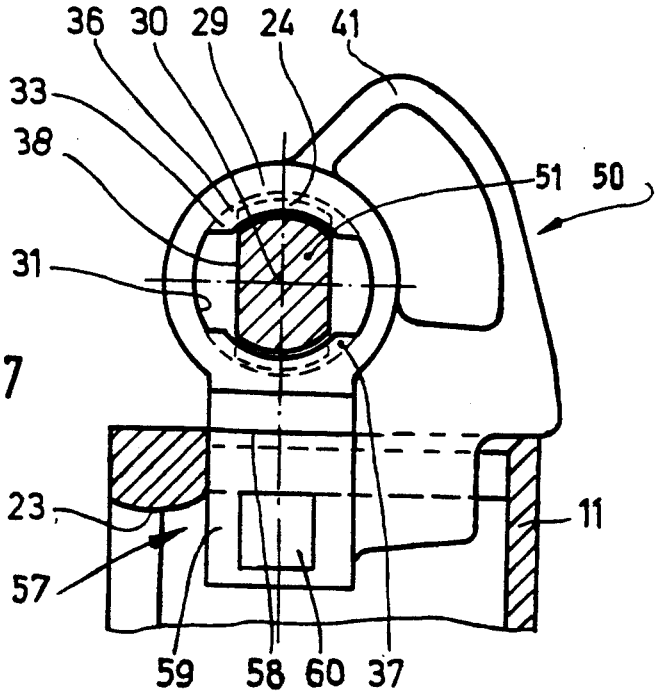
FIG. 7 is a cross-section VII—VII of the bridge fitting according to FIG. 6, showing a cross-sectional view in analogy to FIG. 5.

The bridge fitting 10 according to the second embodiment of the invention is illustrated in FIGS. 6 and 7. It also comprises two connecting pieces 49, 50. In this case, the first connecting piece 49 is formed from several parts and comprises an elongated adjusting portion 51 and a hooking base 52 coupled thereto in an articulated manner.

The hooking base 52 is provided with a hooking portion 53 which is designed such that it retains the hooking base 52 on the corner fitting 11 in an almost rigid, specifically untiltable manner. For this purpose, the hooking base 52 is provided with a support surface 54 resting on the container corner fitting 11. The support surface 54 adjoins a center portion 55 with a crossbar 56 tightly attached thereto. The center portion 55 has an approximately cylindrical design and its dimensions are selected such that it can pass through the recess 14 in the container corner fitting 11. The crossbar 56 has about the same dimensions as the elongated recess 14. As a result, the hooking base 52 of the connecting piece 49 can be inserted into the container corner fitting 11 from above and through the recess 14 in a position which is offset by 90° relative to the representation in FIG. 6. After a rotation of the hooking base 52 through 90° into the position illustrated in FIG. 6, the crossbar 56 reaches a position which is directed transverse to the elongated recess 14 and thus hooks under opposite edge regions of the recess 14 from underneath. The hooking base 52 is thus locked with the container corner fitting 11.

The elongated adjusting portion, which is coupled to the hooking base 52 in an articulated manner, has a plurality of catch steps 20 consisting of projections 26 and depressions 27 arranged one behind the other and located on he end 19 of the adjusting portion facing away from the hooking base 52. These projections 26 and depressions 27 have the same form as those of the adjusting portion 16 of the first embodiment of the bridge fitting 10, and reference is made thereto in this regard.

The second connecting piece 50 essentially corresponds to the connecting piece 13 of the first embodiment. Only the hooking portion 57 is designed to ridigly, i.e. non-tiltably attach the connecting piece 50 to the container corner fitting 11. For this purpose, the hooking portion 57 has a support surface 58 which bears against the top of the container corner fitting 11, specifically on oppositely situated edge regions of the elongate recess 14. Underneath the support surface 58, the hooking portion 57 has a center portion 59 which passes through the elongated recess 14 and projects therefrom towards the inside of the container corner fitting 11. Two opposite detents 60 are arranged in this projecting region of the center portion 59. These detents 60 can be retracted into the center portion 59 for an insertion of the hooking portion 57 into the recess 14 and, after insertion into the container corner fitting 11, they can be extended out of the center portion 59 into the position illustrated in FIG. 6, for locking the hooking portion 57 in the recess 14 of the container corner fitting 11.

Alternatively, it would also be possible to provide a rigid crossbar located below the center portion 59 and approximately corresponding to the crossbar 56 on the hooking base 52. To be able to move such a crossbar between a locking and a releasing position relative to the container corner fitting 11, the hooking portion 57 is rotatably connected to the anchoring sleeve 29 of the connecting piece 50. In this case, the anchoring sleeve 29 is designed like that of the connecting piece 13 of the first embodiment of the bridge fitting 10.

The design of the hooking portion 53 and 57 of the connecting pieces 49 and 50 of the embodiment of the bridge fitting 10 as illustrated in FIGS. 6 and 7 ensures that essentially only tensile loads are exerted on the elongate adjusting portion 51. As a result, the adjusting portion 51 of this embodiment of the bridge fitting 10 can receive higher loads or—with identical loads—can be provided with a smaller cross-section compared to the adjusting portion 16 of the first embodiment. This would reduce the weight of this embodiment compared to the bridge fitting 10 of the first embodiment.

The invention is not limited to the illustrated embodiments. It would for example also be possible to select catch steps and counter catch steps having different type grooves, such as wedge-shaped or trapezoidal grooves or the like. Moreover, the bridge fitting according to the invention could also be inserted without any problems in other recesses than those on the top of two adjacent container corner fittings.

I claim:

1. A device for connecting containers stacked on ships, especially on ship's decks, with:

at least two connecting pieces;

said connecting pieces comprising holding portions which are engageable to container corner fittings of adjacent containers;

said at least two connecting pieces having corresponding projections;

the distance between the holding portions being variable by means of a relative displacement in which the projections of the connecting pieces are not engaged with one another in order to adapt the distance of the holding portions to the distance between the respective containers which are to be connected;

wherein said connecting pieces are relatively moveable in a rotatably manner such that when said connecting pieces are in one relative rotational position, said projections are engaged to lock said connecting pieces against longitudinal movement whereby said holding portions are locked at a selected distance apart, and when said connecting pieces are in another relative rotatable position, said projections are disengaged, allowing longitudinal adjustment of said connecting pieces to selectively vary the distance between said holding portions.

2. The device as claimed in claim 1, wherein said one connecting piece and said other connecting piece are first and second connecting pieces respectively and wherein said first connecting piece has an elongated adjusting portion having said projections defining catch steps spaced at small distances to one another, for receiving said second connecting piece in a shiftable and lockable manner.

3. The device as claimed in claim 2, wherein said first connecting piece has a first holding portion which is arranged on an end of the elongated adjusting portion, which is directed away from the catch steps.

4. The device as claimed in claim 2, wherein the elongated adjusting portion has a circular cross-section having two oppositely situated flat sides in the region of the catch steps, said catch steps being alternating projections and depressions and located on opposite peripheral portions of the elongated adjusting portion.

5. The device as claimed in claim 2, wherein the second connecting piece is shiftably mounted in the axial direction of the elongated adjusting portion of the first connecting piece.

6. The device as claimed in claim 5, wherein the second connecting piece has an anchoring sleeve with at least one counter catch step on an inner periphery, said counter catch step being positively connectable to the corresponding catch steps of the elongated adjusting portion of the first connecting piece.

7. The device as claimed in claim 6, wherein the counter catch steps are formed on the inner periphery of the anchoring sleeve with alternating projections and depressions by annular grooves having a sinusoidal design, said projections and depressions being disposed along a partial inner periphery and corresponding to the projections and depressions of the catch steps located on the elongated adjusting portion of the first connecting place.

8. The device as claimed in claim 1, wherein said holding portions are designed such that, after they are inserted into the container corner fittings, they are held rigidly and utilitably.

9. The device as claimed in claim 2, wherein the elongated adjusting portion includes a securing means in the form of a pin to secure the second connecting piece on the elongated adjusting portion of the first connecting piece.

10. The device as claimed in claim 2, wherein the catch steps are formed by alternating projections and depressions in the region of an end of the elongated adjusting portion as annular grooves.

11. The device as claimed in claim 10, wherein said grooves have a sinusoidal cross sectional shape.

12. A device for connecting containers stacked on ships, especially on ship's decks, with:

at least two connecting pieces;

said connecting pieces comprising holding portions which are engageable to container corner fittings of adjacent containers;

said at least two connecting pieces having corresponding projections;

the distance between the holding portions being variable by means of a relative displacement in which the projections of the connecting pieces are not engaged with one another in order to adapt the distance of the holding portions to the distance between the respective containers which are to be connected;

the projections of these connecting pieces being movable out of engagement by means of a movement of at least the one connecting piece relative to the other connecting piece in one direction, whereby the one connecting piece is freely displaceable relative to the other connecting piece; and the projections being engageable to one another by means of a relative movement of at least the one connecting piece relative to the other connecting piece in another direction in order to non-displaceably lock the one connecting piece on the other connecting piece;

wherein at least one connecting piece is provided with an actuating means, said actuating means being located diametrically on an outer periphery of an anchoring sleeve.

* * * * *